US011653726B1

(12) United States Patent
Ajaj et al.

(10) Patent No.: US 11,653,726 B1
(45) Date of Patent: May 23, 2023

(54) NECKLACE KEEPER

(71) Applicants: Omar S. Ajaj, North Kingstown, RI (US); Rachel L. Ajaj, North Kingstown, RI (US)

(72) Inventors: Omar S. Ajaj, North Kingstown, RI (US); Rachel L. Ajaj, North Kingstown, RI (US)

(73) Assignee: Productive Collaboration, LLC, Cranston, RI (US)

( * ) Notice: Subject to any disclaimer, the term of this patent is extended or adjusted under 35 U.S.C. 154(b) by 158 days.

(21) Appl. No.: 17/392,636

(22) Filed: Aug. 3, 2021

(51) Int. Cl.
*A44C 5/00* (2006.01)
*A44C 15/00* (2006.01)
*A44C 5/20* (2006.01)

(52) U.S. Cl.
CPC ..... *A44C 5/2004* (2013.01); *A44C 5/2014* (2013.01)

(58) Field of Classification Search
CPC ... A44C 5/2004; A44C 5/2015; A44C 5/2009; A44C 5/2014; Y10T 24/1379; Y10T 24/44615; Y10T 70/8757; A44B 15/00; Y10S 70/55
USPC ..... 70/459
See application file for complete search history.

(56) References Cited

U.S. PATENT DOCUMENTS 1,365,911 A * 1/1921 Goozey ..... A44C 5/2009 70/459
1,626,987 A * 5/1927 Venegas ..... A44B 15/00 70/459
2,206,052 A * 7/1940 Schoeninger ..... A44C 5/00 70/459
2,435,152 A * 1/1948 Morse ..... A44B 15/00 70/459
2,556,741 A * 6/1951 Reyburn ..... A01K 27/005 24/375
2,677,267 A * 5/1954 Hetz ..... A44B 15/00 70/459
3,597,951 A * 8/1971 Nadel ..... A44B 15/00 70/459
4,193,278 A * 3/1980 Martinez ..... A44B 15/00 70/459
4,324,121 A * 4/1982 Richter ..... A44B 15/00 70/459
5,050,276 A 9/1991 Pemberton
5,826,309 A 10/1998 Tsamas
5,896,625 A 4/1999 Tanner
6,381,814 B1 5/2002 Colpo
6,804,977 B1 10/2004 Grabelle
(Continued)

*Primary Examiner* — Jack W Lavinder
(74) *Attorney, Agent, or Firm* — Salter & Michaelson

(57) ABSTRACT

A necklace keeper or clasp for securing a jewelry item and for receiving one or more charms. The clasp includes a support member constructed of a support ring that extends less than a full circle so as to define a support ring gap, and a top head piece that extends upwardly from the support ring. A sliding lock pad engages with the top head piece and is normally biased to an extended position. A guide ring is providing having a channel for receiving a support ring and extending less than a full circle so as define a guide ring gap. The sliding lock pad has a lock position in which it engages the support ring to inhibit relative rotation between the support ring and the guide ring; and has a release position in which there is relative rotation between the support ring and the guide ring so that the respective supporting ring gap and guide ring gap each align.

20 Claims, 14 Drawing Sheets

(56) References Cited

U.S. PATENT DOCUMENTS

| | | | |
|---|---|---|---|
| 7,676,894 | B2 | 3/2010 | Bohm et al. |
| 7,966,704 | B2 | 6/2011 | Yurman et al. |
| 9,414,652 | B2 | 8/2016 | Fuhrman et al. |
| 9,770,077 | B2 | 9/2017 | Gibbs |

* cited by examiner

NECKLACE KEEPER

TECHNICAL FIELD

The present invention relates in general to a necklace keeper or clasp. More particularly, the present invention relates to a necklace keeper or clasp that is simple in construction and easy to operate. Furthermore, the present invention relates to a necklace keeper or clasp that can be used for securing ends of the necklace as well as for receiving one or more charms.

BACKGROUND OF THE INVENTION

There are a variety of different clasps used with necklaces. One example is shown in U.S. Pat. No. 5,050,276 to Pemberton. One form of clasp is referred to as a "lobster claw" clasp.

It has been found difficult to manipulate the conventional clasp and thus it is an object of the present invention to provide an improved keeper or clasp that is used with necklaces and that is simple in construction and easy to operate.

SUMMARY OF THE INVENTION

To accomplish the foregoing and other objects of the present invention there is provided a necklace clasp for securing a jewelry item that is comprised of: a support member that includes a support ring that extends less than a full circle so as to define a support ring gap in the support ring, and a top head piece that extends upwardly from the support ring; a sliding lock pad that engages with the top head piece, and that is biased to an extended position; and a guide ring having a channel for receiving the support ring, and extending less than a full circle so as to define a guide ring gap in the guide ring; said sliding lock pad having a locked position in which the sliding lock pad engages the support ring to inhibit relative rotation between the support ring and guide ring, and a released position in which there is relative rotation between the support ring and guide ring so that the respective support ring gap and guide ring gap align.

In accordance with other aspects of the present invention including a spring that is disposed between the top head piece and the sliding lock pad; wherein the spring is a coil spring and the top head piece includes a post for supporting one end of the coil spring; further including a holder for supporting an opposite end of the coil spring; wherein the guide ring has a U-shaped cross-section defining the channel in the guide ring; wherein the top head piece has a passage in which the coil spring resides; wherein the sliding lock pad is comprised of a pair of spaced apart walls with the spring being disposed between the spaced apart walls; wherein the top head piece has a passage in which the coil spring resides, and in the locked position the sliding locking pad is disposed to extend below the top head piece; and wherein the guide ring has a U-shaped cross-section defining the channel in the guide ring.

In accordance with another version of the present invention there is provided a necklace clasp for securing one or more charms to the necklace, comprising: a support member that includes a support ring that extends less than a full circumference so as to define a support ring gap in the support ring, and a top head piece that extends upwardly from the support ring; a spring supported by the top head piece; a sliding lock pad that engages with a passage in the top head piece, and that is biased, by the spring, to an extended position; and a guide ring having a circumferential channel for receiving the support ring, and extending less than a full circumference so as to define a guide ring gap in the guide ring; said sliding lock pad having a locked position in which the sliding lock pad engages the support ring to inhibit relative rotation between the support ring and guide ring, and a released position in which there is relative rotation between the support ring and guide ring so that the respective support ring gap and guide ring gap align; said sliding locking pad, in the released position, allowing said rotation so that said sliding lock pad extends away from the top head piece.

In accordance with still other aspects of the present invention the spring is a coil spring and the top head piece includes a post for supporting one end of the coil spring; further including a holder for supporting an opposite end of the coil spring; wherein the guide ring has a U-shaped cross-section defining the circumferential channel in the guide ring; wherein the top head piece has a passage in which the coil spring resides; wherein the sliding lock pad is comprised of a pair of spaced apart walls with the spring being disposed between the spaced apart walls; wherein the top head piece has a passage in which the coil spring resides, and in the locked position the sliding locking pad is disposed to extend below the top head piece; and wherein the guide ring has a U-shaped cross-section defining the circumferential channel in the guide ring.

In accordance with still another version of the present invention there is provided a necklace clasp for securing one or more charms to the necklace using the clasp, said necklace clasp comprising: a support member that includes a support ring that extends less than a full circumference so as to define a support ring gap in the support ring, and a top head piece that extends upwardly from the support ring; the support ring gap extending less than 180 degrees of the complete circumference of the support ring; a sliding lock pad that engages with a passage in the top head piece; a coil spring supported between spaced apart walls of the sliding lock pad; a guide ring having a circumferential channel for receiving the support ring, and extending less than a full circumference so as to define a guide ring gap in the guide ring; the guide ring gap extending less than 180 degrees of the complete circumference of the guide ring; said sliding lock pad having a locked position in which the sliding lock pad engages the support ring to inhibit relative rotation between the support ring and guide ring, and a released position in which there is relative rotation between the support ring and guide ring so that the respective support ring gap and guide ring gap align; said sliding locking pad, in the released position, allowing said rotation so that said sliding lock pad extends toward the top head piece.

In accordance with still other aspects of the present invention the top head piece has a passage in which the sliding locking pad resides, and in the locked position the sliding locking pad is disposed to extend below and a way from the top head piece; and the guide ring has a U-shaped cross-section defining the circumferential channel in the guide ring.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
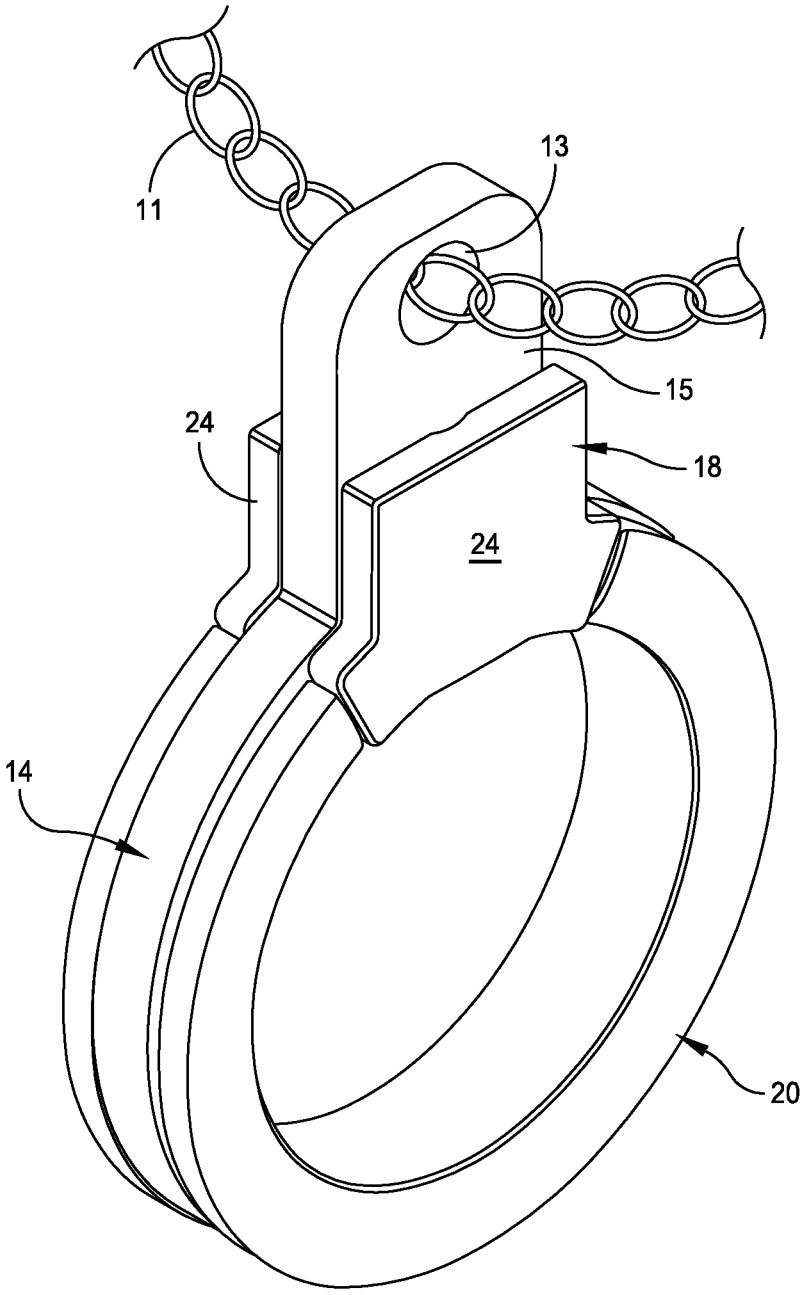
FIG. 1 is a front perspective view of the necklace clasp.
Figure 2:
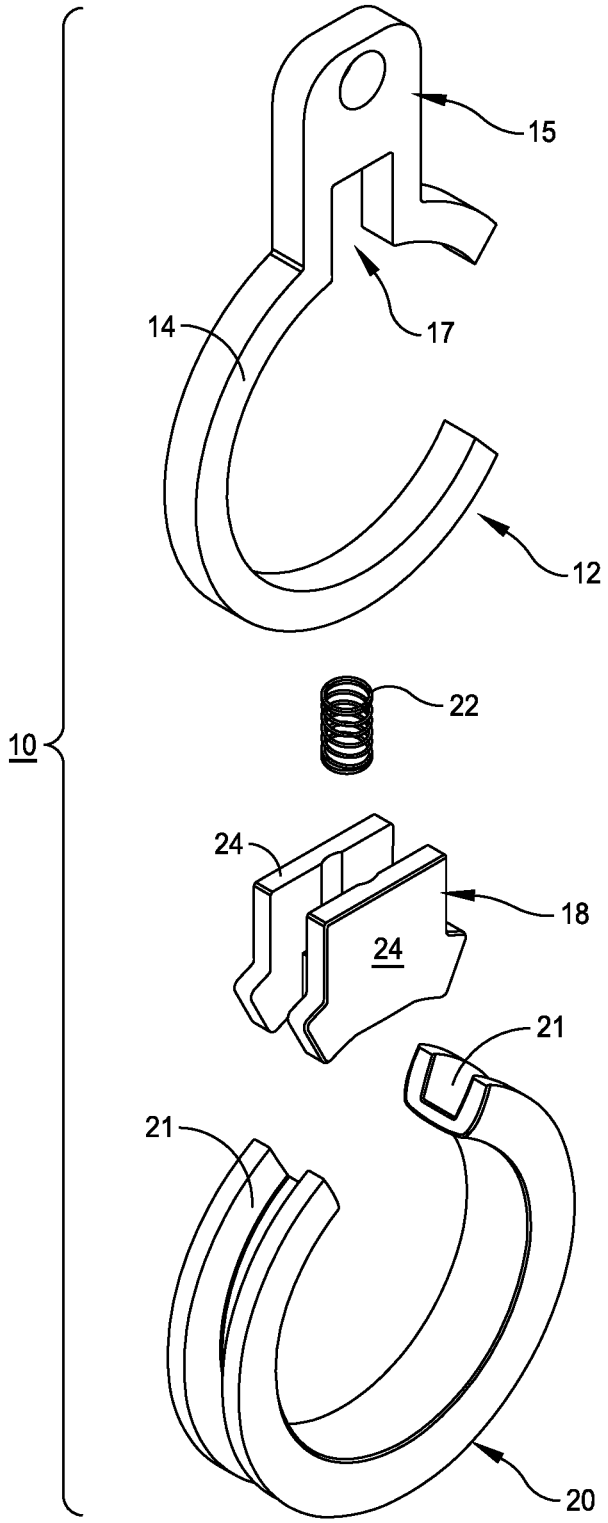
FIG. 2 is an exploded perspective view.
Figure 3:
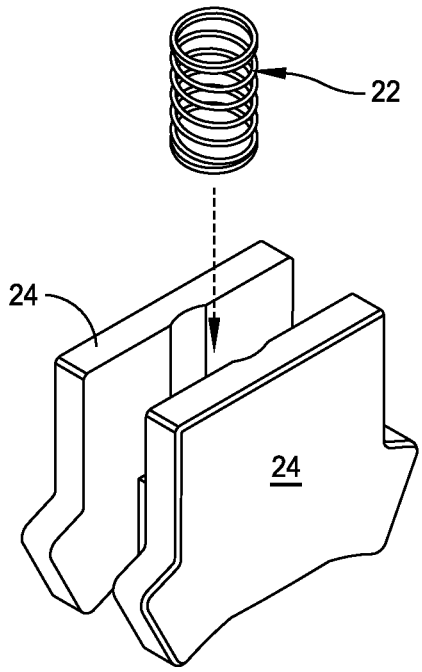
FIG. 3 is a perspective view of the spring installation assembly or sliding lock pad.
Figure 4:
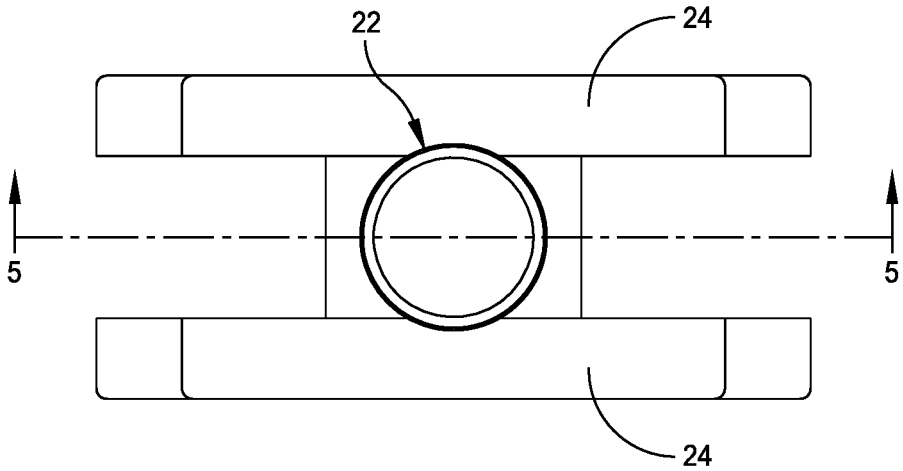
FIG. 4 is a top view of the spring installation assembly or sliding lock pad.
Figure 5:
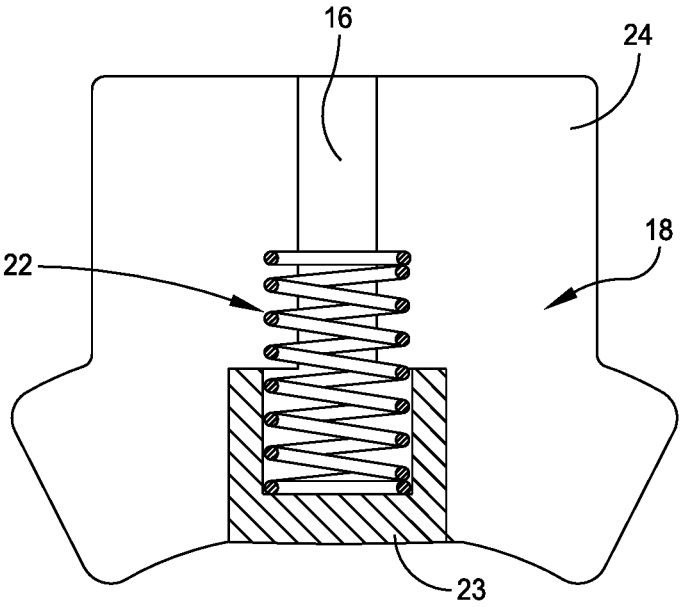
FIG. 5 is a cross-sectional view taken along line 5-5 of FIG. 4.
Figure 6:
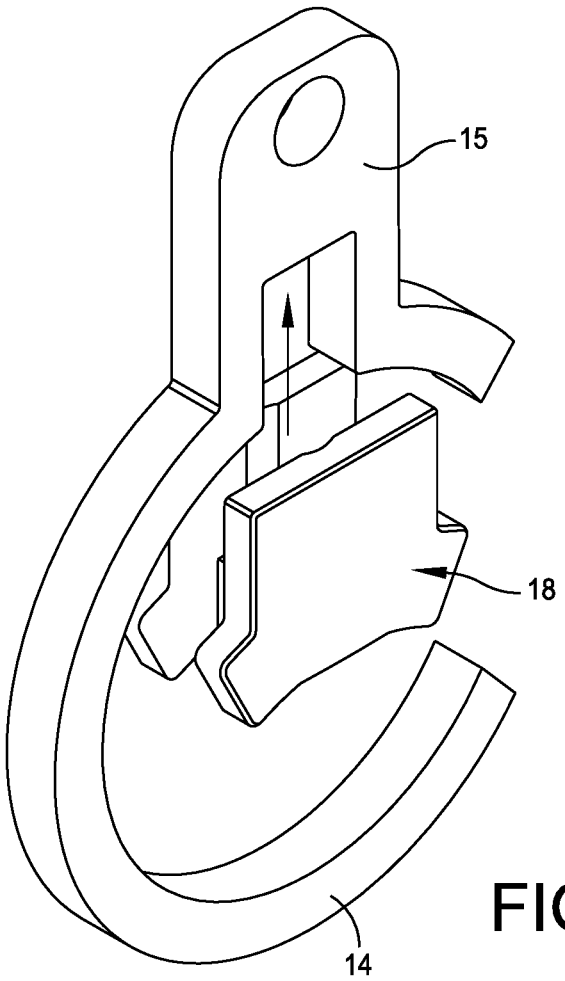
FIG. 6 is a perspective view illustrating the manner in which the spring assembly or sliding lock pad engage with the support ring.
Figure 7:
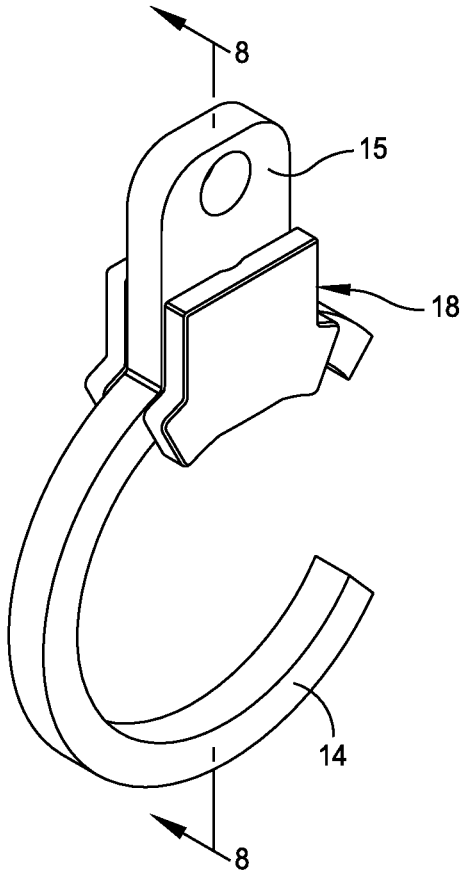
FIG. 7 is a perspective view of the support member.

The present clasp or keeper is shown at 10 in the drawings and can be used for supporting ends of a necklace 11. The keeper or clasp of the present invention is also usable for supporting one or more charms schematically illustrated in the drawings at 25.

Reference may now be made to FIGS. 1-10 for an illustration of the various components that comprise the keeper of the present invention. The cross-sectional views of FIGS. 12-15 are helpful in illustrating the operation of the keeper of the present invention.

In according with the present invention, there is provided a necklace keeper or clasp for securing one or more charms with the necklace. This necklace keeper or clasp is comprised of a support member 12 that is comprised of a support ring 14 that extends less than a full circumference so as to define a support ring gap in the support ring. The support member also includes a top head piece 15 that extends upwardly from the support ring 14. Reference may be made, for example, to FIGS. 2 and 6-10 for the construction of the support member.

Figure 8:
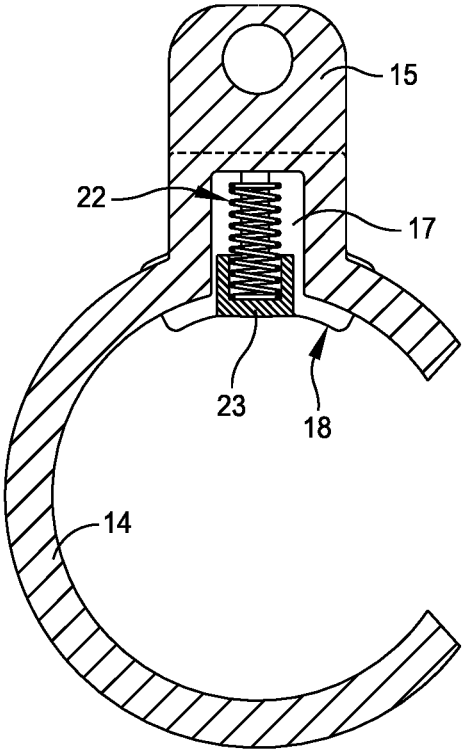
FIG. 8 is a cross-sectional view taken along line 8-8 of FIG. 7.
Figure 9:
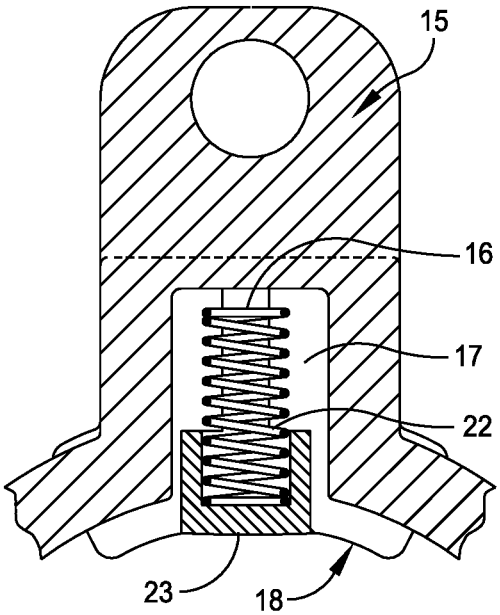
FIG. 9 is a fragmentary enlarged view from FIG. 8.

The necklace keeper or clasp of the present invention also includes a spring 22 which in the illustrated embodiment is a coil spring. This is supported by the sliding lock pad 18 that engages with the passage 17 in the top head piece 15. For example, refer to FIG. 3 that illustrates the coil spring 22 disposed between spaced apart and parallel walls 24 that comprise the sliding lock pad 18. Refer also to FIGS. 5-9 that illustrate the positioning of the sliding lock pad 18 relative to the top head piece 15. FIGS. 8 and 9 illustrate the coil spring at 22. There may be provided a post 16 for supporting the coil spring as illustrated in FIG. 9 and a holder 23 at the base of the sliding lock pad 18. The post 16 may be supported from either the top head piece 15 or from the sliding lock pad 18. The holder 23 preferably bridges between the walls 24. Between the lock pad 18 and the head piece 15 there may be provided engagement surfaces so that the lock pad 18 can easily slide relative to the head piece 15. Indentations may also be provided between the lock pad 18 and the head piece 18 so that the movement is smooth. FIGS. 8 and 9 illustrate the sliding lock pad in its extended position where it is biased away from the top head piece.

Figure 10:
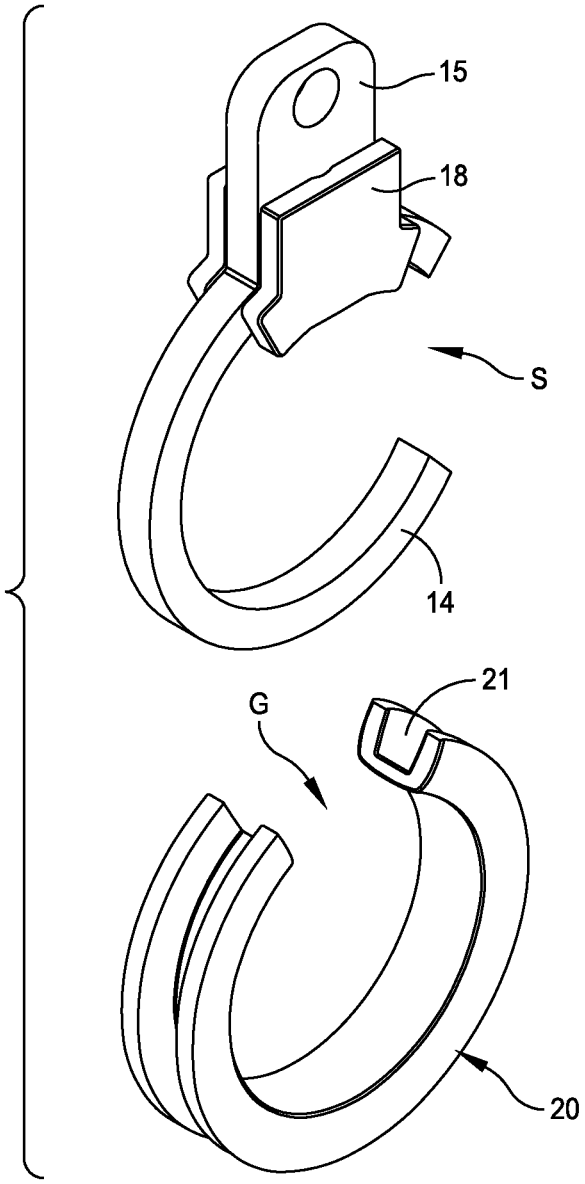
FIG. 10 is an exploded perspective view illustrating the support member and the guide ring.
Figure 11:
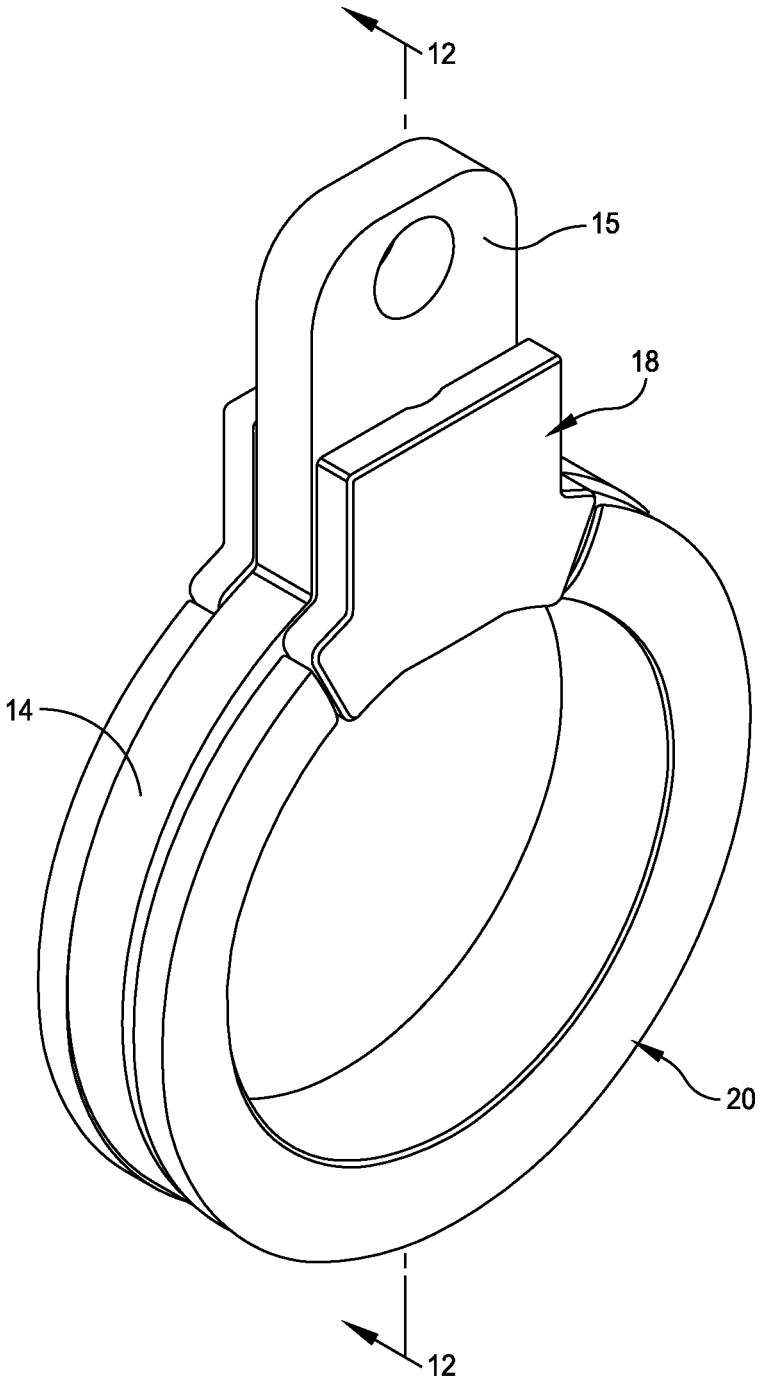
FIG. 11 is a perspective view illustrating the components as assembled.
Figure 12:
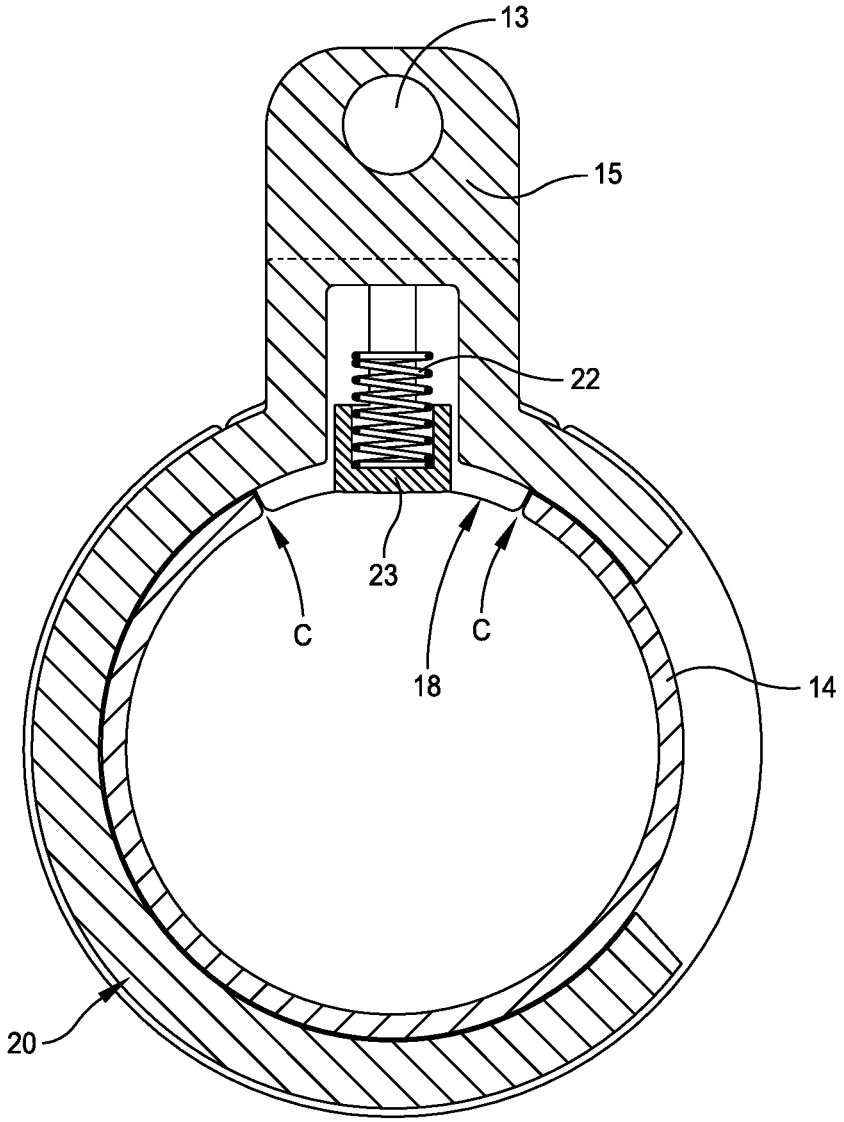
FIG. 12 is a cross-sectional view taken along line 12-12 of FIG. 11.

The necklace keeper or clasp of the present invention also includes a guide ring 20 having a circumferential channel or slot 21. The slot 21 has a U-shaped cross-section. Refer, for example, to FIG. 10 that illustrates in an exploded perspective view the guide ring 20 and the circumferential slot 21. The guide ring 20 extends less than a full circumference so as to define a guide ring gap in the guide ring. Again, refer in FIG. 10 to the gap G in the guide ring 20 and the gap S in the support ring 14.

The sliding lock pad 18 has a lock position in which the sliding lock pad 18 engages the support ring 14 to inhibit relative rotation between the support ring 14 and the guide ring 20. This lock position is illustrated, for example, in FIGS. 7-9 where the sliding lock pad 18 is in its lowermost position. Refer also to the cross-sectional view of FIG. 12 that shows the sliding lock pad 18 contacting the support ring 14 at C. In this position the support ring 14 and the guide ring 20 maintain in a locked position.

The sliding lock pad 18 also has a release position so that there can be relative rotation between the support ring 14 and the guide ring 20. In that position the respective support and guide ring gaps S and G are aligned.

Figure 13:
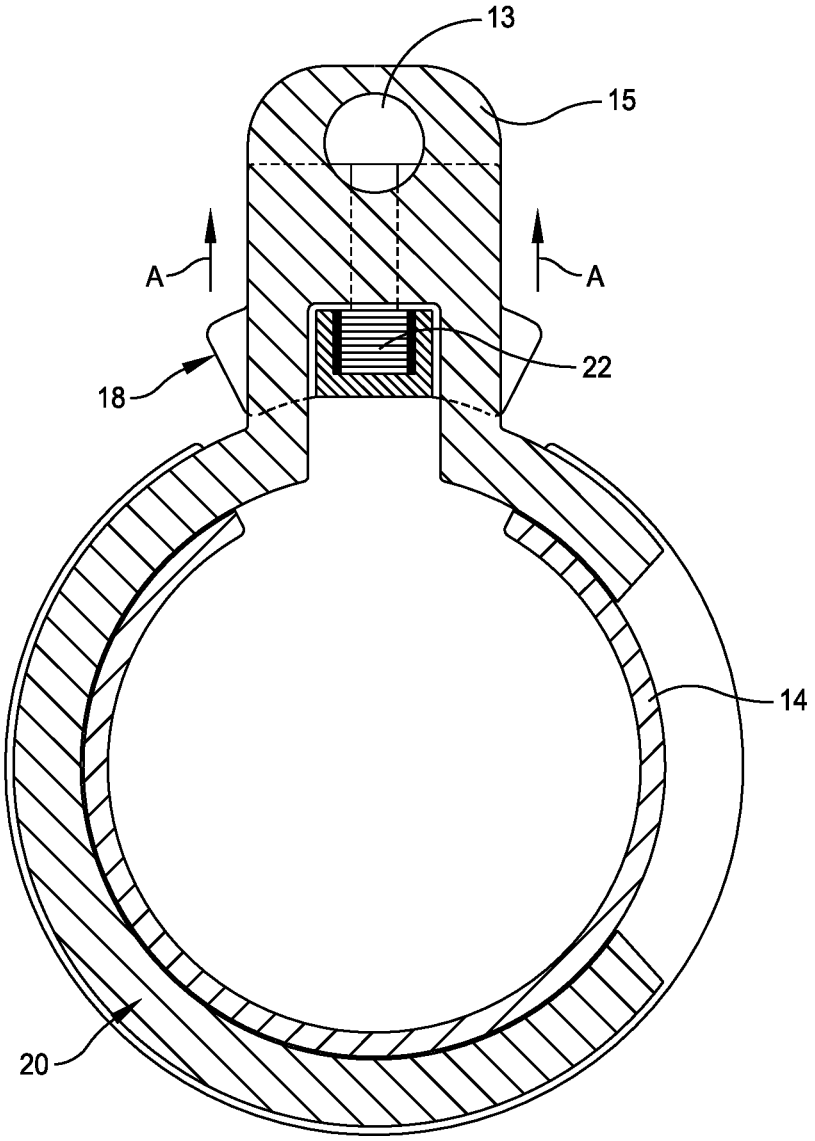
FIG. 13 is a cross-sectional view similar to that shown in FIG. 12 but with the sliding lock pad in an upper position.
Figure 14:
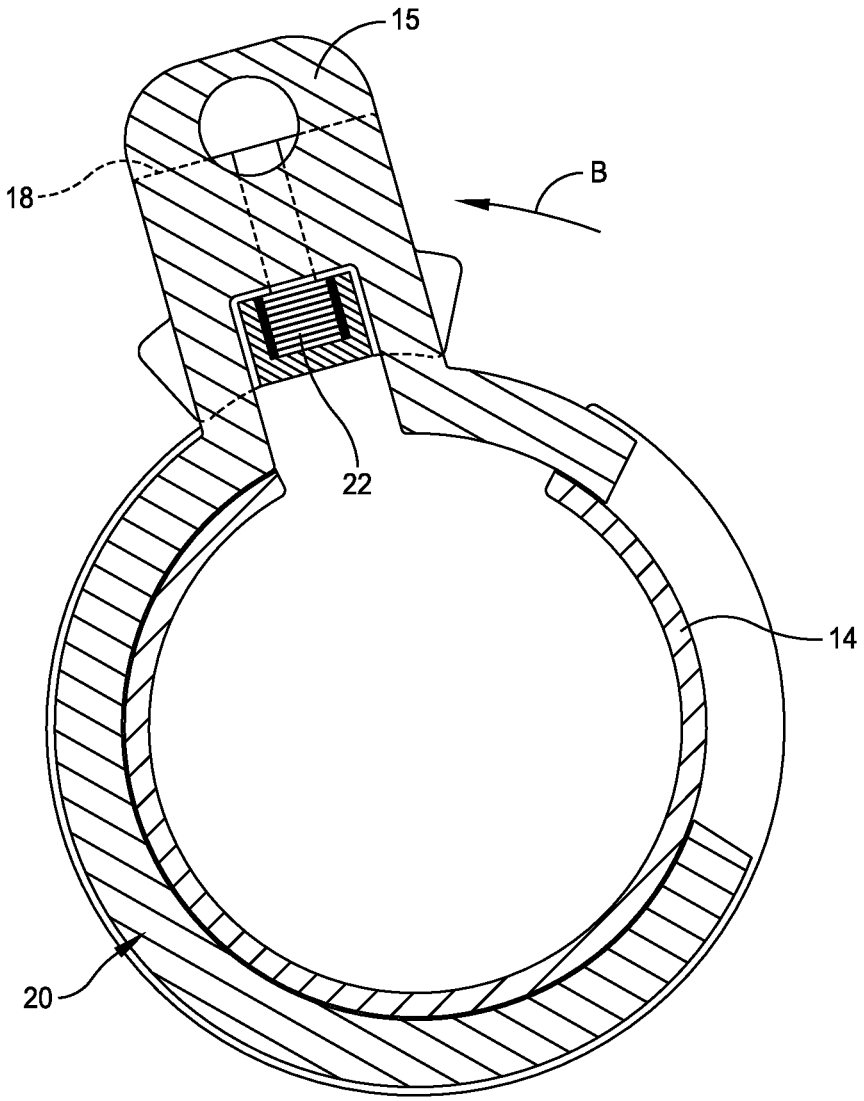
FIG. 14 is a cross-sectional view like that shown in FIGS. 12 and 13 with the sliding lock pad being rotated.
Figure 15:
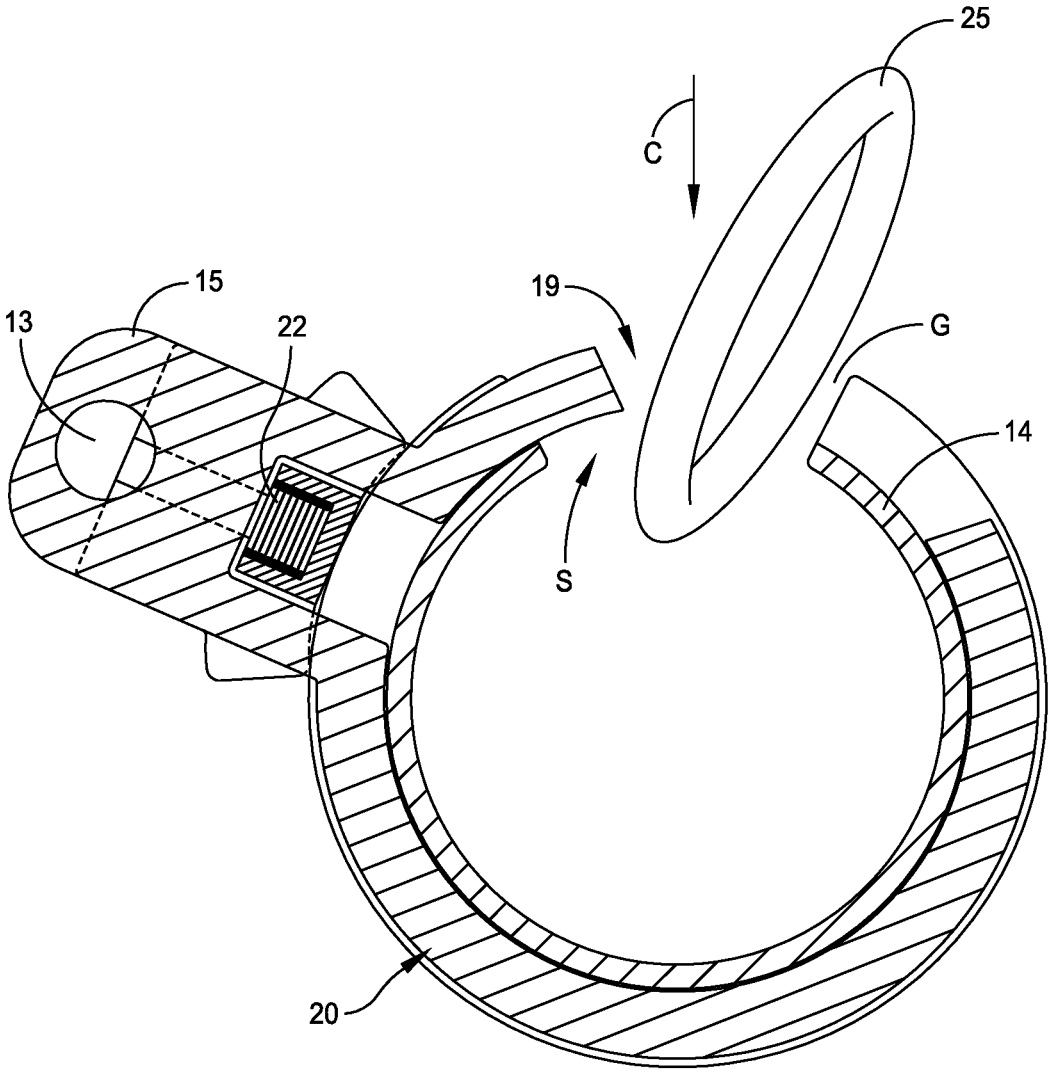
FIG. 15 is cross-sectional view with the clasp in an open position.
Figure 16:
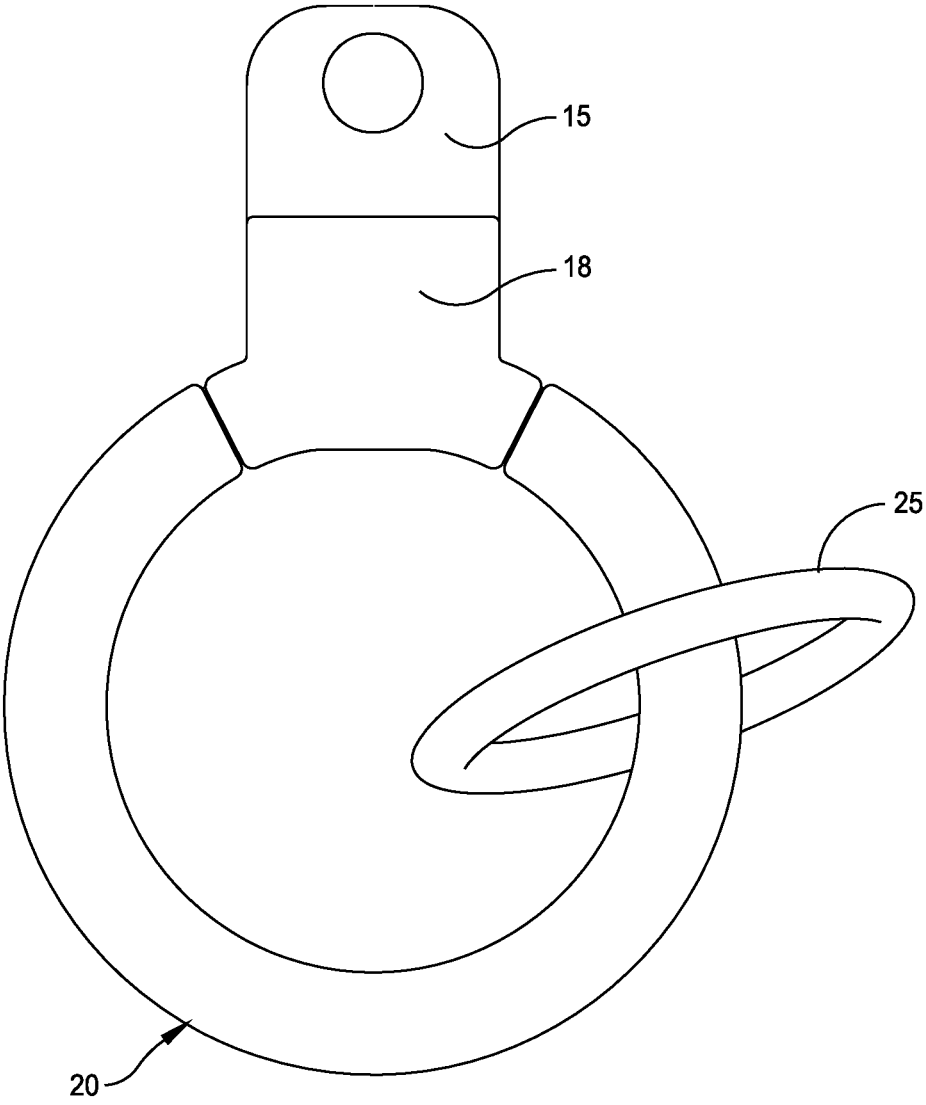
FIG. 16 is a front view with the clasp locked and supporting a charm.

Reference may now be made to the cross-sectional view of FIG. 13 which shows the sliding lock pad 18 being moved upwardly in the direction of arrows A against the bias of the spring 22. The cross-sectional view of FIG. 14 illustrates the initiation of rotation between the support ring 14 and the guide ring 20. Finally, in FIG. 15 the respective gaps S and G align. In FIG. 15 the arrow C indicates the charm 25 being passed through the aligned gaps. Finally, the side elevation view of FIG. 16 illustrates the necklace keeper or clasp being returned to a locked position but with the charm 25 being secured.

Figure 17:
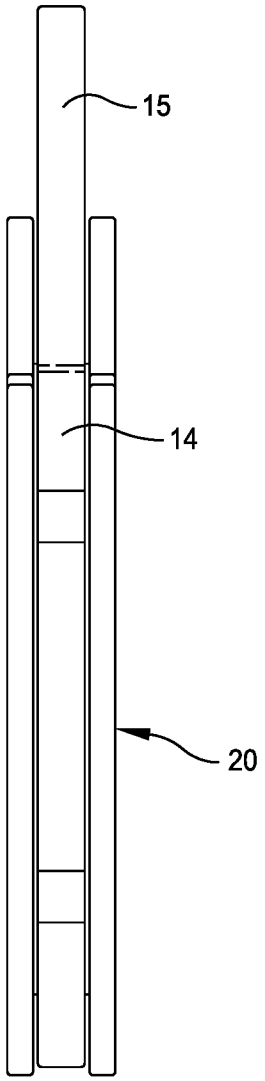
FIG. 17 is a left side view.
Figure 18:
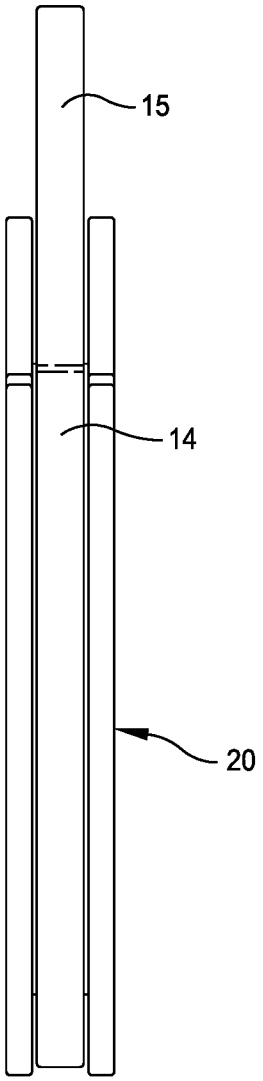
FIG. 18 is a right side view.
Figure 19:
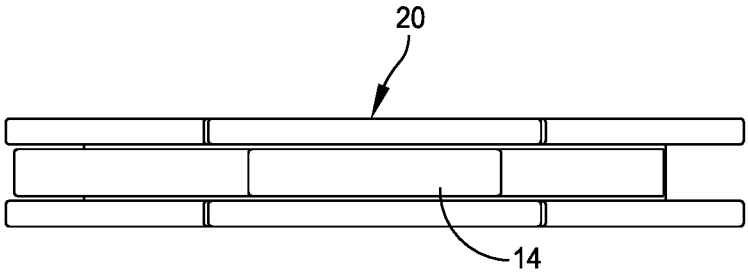
FIG. 19 is a top view.
Figure 20:
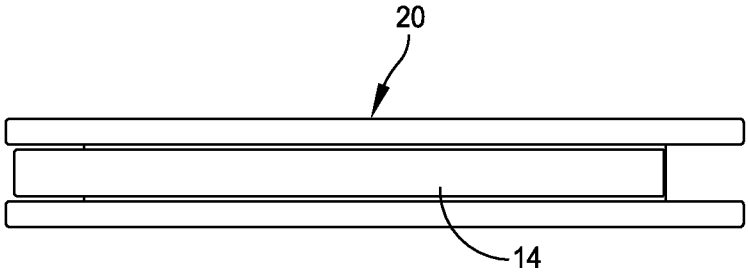
FIG. 20 is a bottom view.

FIG. 17 is a left side view. FIG. 18 is a right side view. FIG. 19 is a top view. FIG. 20 is a bottom view.

REFERENCE NUMBERS

10 Clasp
11 necklace
12 support member
13 hole in top head piece
14 support ring
15 top head piece
16 post for supporting the coil spring
17 passage in top head piece
18 sliding lock pad
19 opening
20 guide ring
21 slot in the guide ring
22 coil spring
23 spring holder
24 spaced apart walls
25 charm

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A necklace clasp for securing a jewelry item comprising:

a support member that includes a support ring that extends less than a full circle so as to define a support ring gap in the support ring, and a top head piece that extends upwardly from the support ring;

a sliding lock pad that engages with the top head piece, and that is biased to an extended position; and a guide ring having a channel for receiving the support ring, and extending less than a full circle so as to define a guide ring gap in the guide ring;

said sliding lock pad being moved to an extended locked position engaging with the guide ring gap to inhibit relative rotation between the support ring and guide ring, and a released position to allow relative rotation between the support ring and guide ring to enable alignment of the support ring gap and guide ring gap.

2. The necklace clasp of claim 1 further including a spring that is disposed between the top head piece and the sliding lock pad.

3. The necklace clasp of claim 2 wherein the spring is a coil spring and the top head piece includes a post for supporting one end of the coil spring.

4. The necklace clasp of claim 3 further including a holder for supporting an opposite end of the coil spring.

5. The necklace clasp of claim 4 wherein the guide ring has a U-shaped cross-section defining the channel in the guide ring.

6. The necklace clasp of claim 5 wherein the top head piece has a passage in which the coil spring resides.

7. The necklace clasp of claim 1 wherein the sliding lock pad is comprised of a pair of spaced apart walls with the spring being disposed between the spaced apart walls.

8. The necklace clasp of claim 7 wherein the top head piece has a passage in which the coil spring resides, and in the locked position the sliding locking pad is disposed to extend below the top head piece.

9. The necklace clasp of claim 8 wherein the guide ring has a U-shaped cross-section defining the channel in the guide ring.

10. A necklace clasp for securing one or more charms to the necklace, comprising:

a support member that includes a support ring that extends less than a full circumference so as to define a support ring gap in the support ring, and a top head piece that extends upwardly from the support ring;

a spring supported by the top head piece;

a sliding lock pad that engages with a passage in the top head piece, and that is biased, by the spring, to an extended position; and a guide ring having a circumferential channel for receiving the support ring, and extending less than a full circumference so as to define a guide ring gap in the guide ring;

said sliding lock pad being moved to an extended locked position engaging with the guide ring gap to inhibit relative rotation between the support ring and guide ring, and a released position to allow relative rotation between the support ring and guide ring to enable alignment of the support ring gap and guide ring gap.

11. The necklace clasp of claim 10 wherein the spring is a coil spring and the top head piece includes a post for supporting one end of the coil spring.

12. The necklace clasp of claim 11 further including a holder for supporting an opposite end of the coil spring.

13. The necklace clasp of claim 12 wherein the guide ring has a U-shaped cross-section defining the circumferential channel in the guide ring.

14. The necklace clasp of claim 13 wherein the top head piece has a passage in which the coil spring resides.

15. The necklace clasp of claim 10 wherein the sliding lock pad is comprised of a pair of spaced apart walls with the spring being disposed between the spaced apart walls.

16. The necklace clasp of claim 15 wherein the top head piece has a passage in which the coil spring resides, and in the locked position the sliding locking pad is disposed to extend below the top head piece.

17. The necklace clasp of claim 16 wherein the guide ring has a U-shaped cross-section defining the circumferential channel in the guide ring.

18. A necklace clasp for securing one or more charms to the necklace using the clasp, said necklace clasp comprising:

a support member that includes a support ring that extends less than a full circumference so as to define a support ring gap in the support ring, and a top head piece that extends upwardly from the support ring;

the support ring gap extending less than 180 degrees of the complete circumference of the support ring;

a sliding lock pad that engages with a passage in the top head piece;

a coil spring supported between spaced apart walls of the sliding lock pad;

a guide ring having a circumferential channel for receiving the support ring, and extending less than a full circumference so as to define a guide ring gap in the guide ring;

the guide ring gap extending less than 180 degrees of the complete circumference of the guide ring;

said sliding lock pad being moved to an extended locked position engaging with the guide ring gap to inhibit relative rotation between the support ring and guide ring, and a released position to allow relative rotation between the support ring and guide ring to enable alignment of the support ring gap and guide ring gap.

19. The necklace clasp of claim 18 wherein the top head piece has a passage in which the sliding locking pad resides, and in the locked position the sliding locking pad is disposed to extend below and away from the top head piece.

20. The necklace clasp of claim 19 wherein the guide ring has a U-shaped cross-section defining the circumferential channel in the guide ring.

* * * * *